US009593526B2

(12) United States Patent
Wang Chen

(10) Patent No.: US 9,593,526 B2
(45) Date of Patent: Mar. 14, 2017

(54) DOOR STRUCTURE WITH GLASS

(71) Applicant: NAN YA PLASTICS CORPORATION, Taipei (TW)

(72) Inventor: Kuei Yung Wang Chen, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 14/448,394

(22) Filed: Jul. 31, 2014

(65) Prior Publication Data

US 2016/0032640 A1 Feb. 4, 2016

(51) Int. Cl.

| | |
|---|---|
| ***E06B 3/58*** | (2006.01) |
| ***E06B 3/82*** | (2006.01) |
| ***E06B 3/964*** | (2006.01) |
| *E06B 3/70* | (2006.01) |

(52) U.S. Cl.

CPC ..... *E06B 3/5892* (2013.01); *E06B 3/822* (2013.01); *E06B 3/9641* (2013.01); *E06B 3/5842* (2013.01); *E06B 2003/7011* (2013.01)

(58) Field of Classification Search

CPC ..... E06B 3/5892; E06B 3/5878

See application file for complete search history.

(56) References Cited

U.S. PATENT DOCUMENTS 4,327,535 A * 5/1982 Governale ..... E06B 3/5892 49/501
4,525,966 A * 7/1985 Litchfield et al. ..... 52/204.591
4,546,585 A * 10/1985 Governale ..... 52/309.11
4,897,975 A * 2/1990 Artwick et al. ..... 52/208
5,018,330 A * 5/1991 Lewkowitz ..... 52/455
5,666,773 A * 9/1997 Librande et al. ..... 52/202
5,887,398 A * 3/1999 Chen ..... 52/309.9
6,029,402 A * 2/2000 Carney ..... E06B 3/02 49/399
6,553,735 B1 * 4/2003 Wang Chen ..... 52/455
7,520,105 B2 * 4/2009 Geller ..... 52/784.1
7,721,501 B2 * 5/2010 Lynch et al. ..... 52/456
7,997,040 B2 * 8/2011 Lynch ..... E06B 3/5892 52/309.9
8,904,733 B2 * 12/2014 Thompson ..... E06B 1/36 49/504
2002/0092254 A1 * 7/2002 Wang Chen ..... 52/455
2014/0053488 A1 * 2/2014 Lenox ..... E06B 3/26303 52/404.1
2014/0262072 A1 * 9/2014 Shives ..... 160/201

FOREIGN PATENT DOCUMENTS

EP 2042678 A1 * 4/2009 ..... E06B 3/96
GB 2252999 A * 8/1992 ..... E06B 3/72

* cited by examiner

*Primary Examiner* — Elizabeth A Quast
(74) *Attorney, Agent, or Firm* — Bacon & Thomas, PLLC

(57) ABSTRACT

A door structure with glass at least comprising a front panel, a rear panel, an inner hollowed-frame assembly, a glass mounted assembly and at least one glass, wherein the front panel and the rear panel are configured with a plurality of positioning protrusions at inner sides for assembling the inner hollowed-frame assembly inside the door structure with glass without using screws; the structure may render the inner hollowed-frame assembly able to support and assemble the glass mounted assembly and the glass with rigidity.

9 Claims, 8 Drawing Sheets

DOOR STRUCTURE WITH GLASS

BACKGROUND OF THE INVENTION

1. Field of the Invention Technical Field

The invention relates to a door structure with glass, and more particularly, to a door structure with glass having an inner hollowed-frame assembly configured inside the door and does not require using screws to assemble.

2. Description of Related Art

FIG. 1 shows a conventional door structure 10 with glass 80 comprising two hollow door panels 11 and 12, four edge seals 13, four hollow portion edge seals 14, four glass stops 15, and at least one glass 80.

The four edge seals 13 constitute the four outer side frames of the two hollow door panels 11 and 12, and the four hollow portion edge seals 14 constitute the four inner side frames of the two hollow door panels 11 and 12. After the four edge seals 13 and the four hollow portion edge seals 14 have been assembled to the two hollow door panels 11 and 12 by adhesive bonding, polyurethane (PU) foamed plastic 16 is filled into the space between the two hollow door panels 11 and 12 to reinforce the structural strength of door 10.

The four hollow portion edge seals 14 are configured with a groove for the positioning of the glass 80 and the glass stop 15, and when the glass 80 is located at the assembly location, the glass stop 15 is utilized to fix the glass 80 to assemble the door structure with glass 10.

However, the conventional door structure 10 with glass 80 only uses the four hollow portion edge seals 14 to support the weight of the glass 80 and has a shortcoming of insufficient structural strength, and the filling of polyurethane (PU) foamed plastic 16 inside the door 10 is not cost effective.

SUMMARY OF THE PRESENT INVENTION

In view of the above, the main purpose of the present invention is to provide a door structure with glass, comprising: two panels, configured with a hollow portion for installing glass and constituting a front panel and a rear panel of a door, respectively; two vertical stiles, constituting a left stile and a right stile between the front panel and the rear panel, respectively; and two horizontal rails, constituting a top rail and a bottom rail between the front panel and the rear panel, respectively, wherein the front panel and the rear panel are configured with a plurality of positioning protrusions at inner sides around the hollow portion and further comprises: an inner hollowed-frame assembly, fixed in between the plurality of positioning protrusions of the front panel and the plurality of positioning protrusions of the rear panel; two reinforcing materials, assembled in between the vertical stiles, horizontal rails, and the inner hollowed-frame assembly; a glass mounted assembly, assembled on an inner side of the inner hollowed-frame assembly and is combined in one with the inner hollowed-frame assembly; at least one glass, located at a mounting location of the glass mounted assembly; and at least three glass stops, constituting sealing stops of the glass by combining with the glass mounted assembly by mortise and tenon joints.

The material of the front panel, the rear panel, the vertical stiles, the horizontal rails, the inner hollowed-frame assembly, the reinforcing materials, the glass mounted assembly or the glass stops is metal, wood or plastic in a preferred embodiment.

Both sides of the front panel and the rear panel are configured into L-shaped tenon plates, and wherein sides of the vertical stiles that contact with the front panel and the rear panel are configured with vertical grooves, respectively, for the L-shaped tenon plate of the front panel and the L-shaped tenon plate of the rear panel to engage and lock, respectively, in a preferred embodiment.

The inner hollowed-frame assembly comprises at least three inner frame modules and at least three connector pieces, wherein a mortise is configured at each of two ends of a body of the inner frame module, wherein the body of the inner frame module is configured with a groove, wherein the connector piece is configured with a first tenon and a second tenon, and wherein the first tenon of the connector piece combines with the mortise of the inner frame module by a mortise and tenon joint and the second tenon of the connector piece combines with the mortise of another neighboring inner frame module by a mortise and tenon joint in a preferred embodiment.

The angle between the first tenon and the second tenon of the connector piece is of 60 degrees, 90 degrees, 120 degrees or 150 degrees in a preferred embodiment.

The glass mounted assembly comprises at least three edge-sealing frame modules, wherein the edge-sealing frame module comprises a mounting portion and a hook rib portion, wherein the hook rib portion combines with a corresponding groove of the inner frame module by a mortise and tenon joint, and wherein a side of the glass is located at the mounting portion in a preferred embodiment.

The edge-sealing frame module further comprises a mortise portion, and wherein the glass stop is configured with a tenon portion to combine with the mortise portion of the edge-sealing frame module by a mortise and tenon joint in a preferred embodiment.

The glass is substituted with a metal, wooden or plastic ornamental panel in a preferred embodiment.

The invented door structure with glass has the following advantages:

(1) the door has the inner hollowed-frame assembly configured inside which is favorable to securely support and assemble the glass mounted assembly and the glass with rigidity;

(2) the overall structure of the door is substantially rigid, resulted in that the interior of the door is optionally and not required to be filled with polyurethane (PU) foamed plastics; and (3) most components of the door are combined by mortise and tenon joints and do not require using screws to assemble.

DETAILED DESCRIPTION OF THE PREFERRED EMBODIMENT

Figure 1:
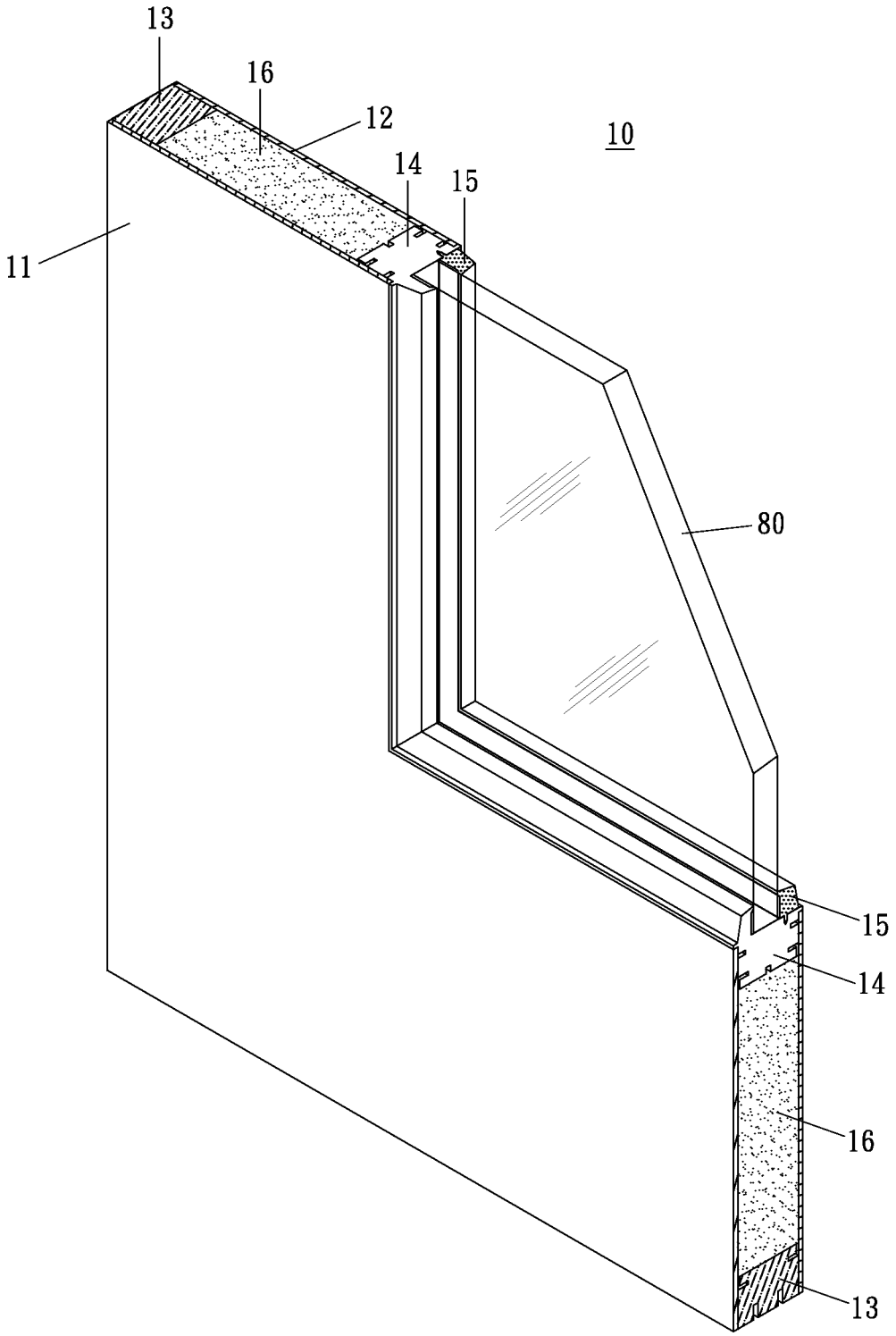
FIG. 1 (prior art)
FIG. 1 is a detailed cross-sectional schematic of a conventional door structure with glass.

FIG. 2 to FIG. 8 show an embodiment of a door structure 20 with glass 80 of the present invention comprising two panels 21 and 22 of identical structure, two vertical stiles 23 and 25 of identical structure, two horizontal rails 27 and 29 of identical structure, two reinforcing materials 30 of identical structure, an inner hollowed-frame assembly 40, a glass mounted assembly 50, two horizontal glass stops 60 and 65 of identical structure, two vertical glass stops 70 and 75 of identical structure, and at least one glass 80, and all components assembled together as the door structure 20 with glass 80 by mortise and tenon joints and do not require using screws to assemble.

The two vertical stiles 23 and 25 are door stiles of identical structure, and constitute a left stile and a right stile of the door structure 20, respectively, when assembled.

The sides of the vertical stile 23 that contact with the panels 21 and 22 are configured with vertical grooves 23*a*, and the sides of the vertical stile 25 that contact with the panels 21 and 22 are also configured with corresponding vertical grooves 25*a*. The material of the vertical stiles 23 and 25 may be metal, wood or plastic.

The two horizontal rails 27 and 29 are door rails of identical structure, and constitute a top rail and a bottom rail of the door structure 20, respectively, when assembled by adhesive bonding. The material of the horizontal rails 27 and 29 may be metal, wood or plastic.

As shown in FIG. 3 to FIG. 8, the inner hollowed-frame assembly 40 constitutes an inner frame of the door structure 20 that is used for assembling the glass mounted assembly 50 and supporting the weight of the glass 80.

The inner hollowed-frame assembly 40 comprises at least three inner frame modules 41 and at least three connector pieces 45. The material of the inner hollowed-frame assembly 40 may be metal, wood or plastic.

Figure 5:
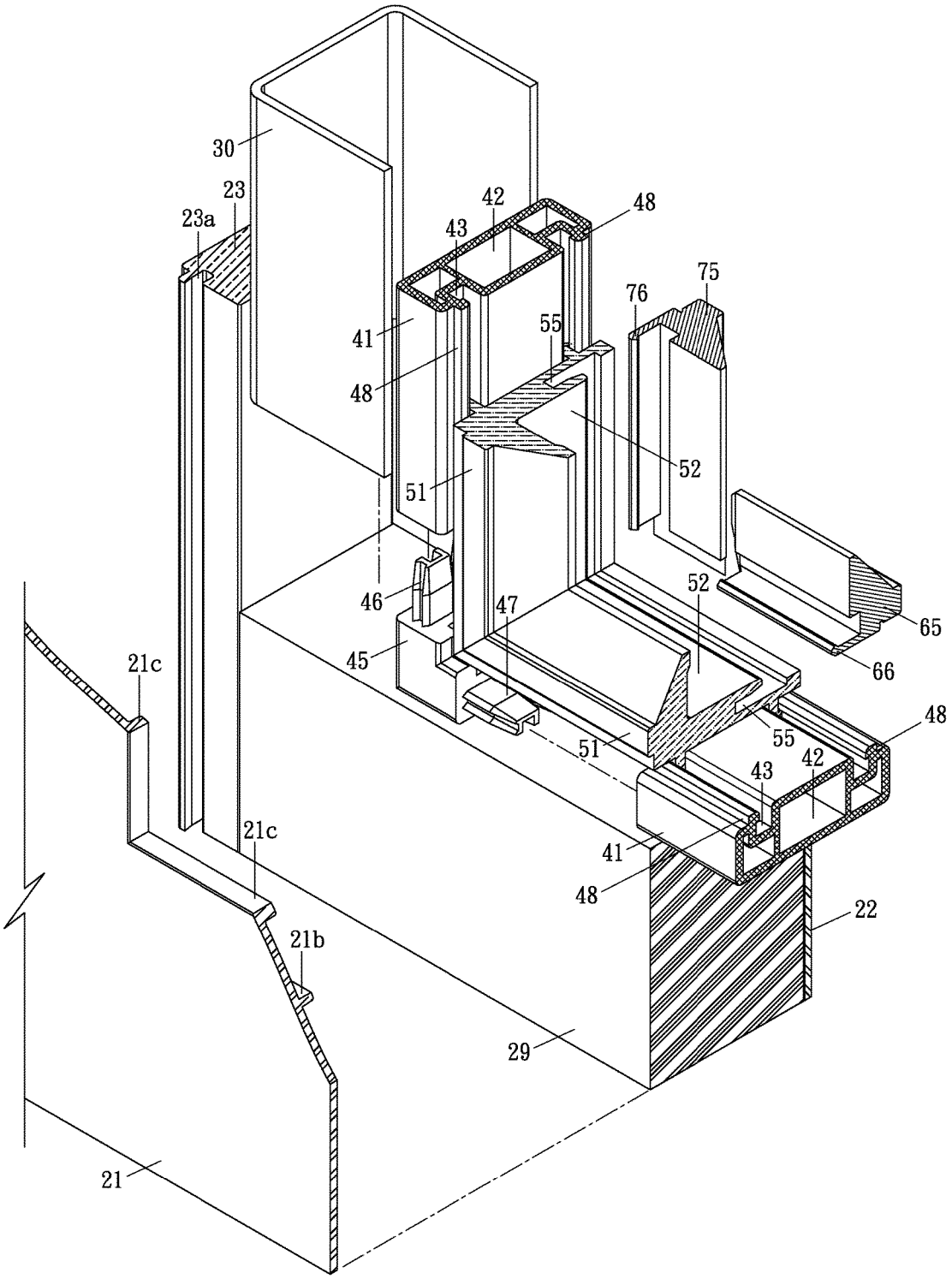
FIG. 5 is an exploded view of the door structure with glass along 4-4 in FIG. 2.

As shown in FIG. 5, the inner frame module 41 is an elongated body at least comprising a mortise 42, a groove 43, and a locating wall 48; the mortise 42 is configured at each of two ends of the elongated body of the inner frame module 41, and the groove 43 is formed along the elongated body of the inner frame module 41, and the locating wall 48 is formed with a raised protrusion parallel to the groove 43.

The connector piece 45 is configured with a first tenon 46 and a second tenon 47, wherein the angle between the first tenon 46 and the second tenon 47 may be of 60 degrees, 90 degrees, 120 degrees, 150 degrees, or other angles.

The first tenon 46 and the second tenon 47 of the connector piece 45 may connect with the mortise 42 of the inner frame module 41 by a mortise and tenon joint. Therefore, the two ends of the inner frame module 41 may be connected to another identical inner frame module 41 via the mortise and tenon joint of the connector piece 45.

The outer contour of the inner hollowed-frame assembly 40 accords with itself hollow contour thereof, and when the contour is triangular, the connector piece 45 having an angle of 60 degrees between the first tenon 46 and the second tenon 47 may be selected and the inner hollowed-frame assembly 40 is constituted by three inner frame modules 41 and three connector pieces 45; when the contour is rectangular, the connector piece 45 having an angle of 90 degrees between the first tenon 46 and the second tenon 47 may be selected and the inner hollowed-frame assembly 40 is constituted by four inner frame modules 41 and four connector pieces 45; when the contour is hexagonal, the connector piece 45 having an angle of 120 degrees between the first tenon 46 and the second tenon 47 may be selected and the inner hollowed-frame assembly 40 is constituted by five inner frame modules 41 and five connector pieces 45; and so on. The outer contour and hollow contour of the inner hollowed-frame assembly 40 is preferably rectangular.

Figure 4:
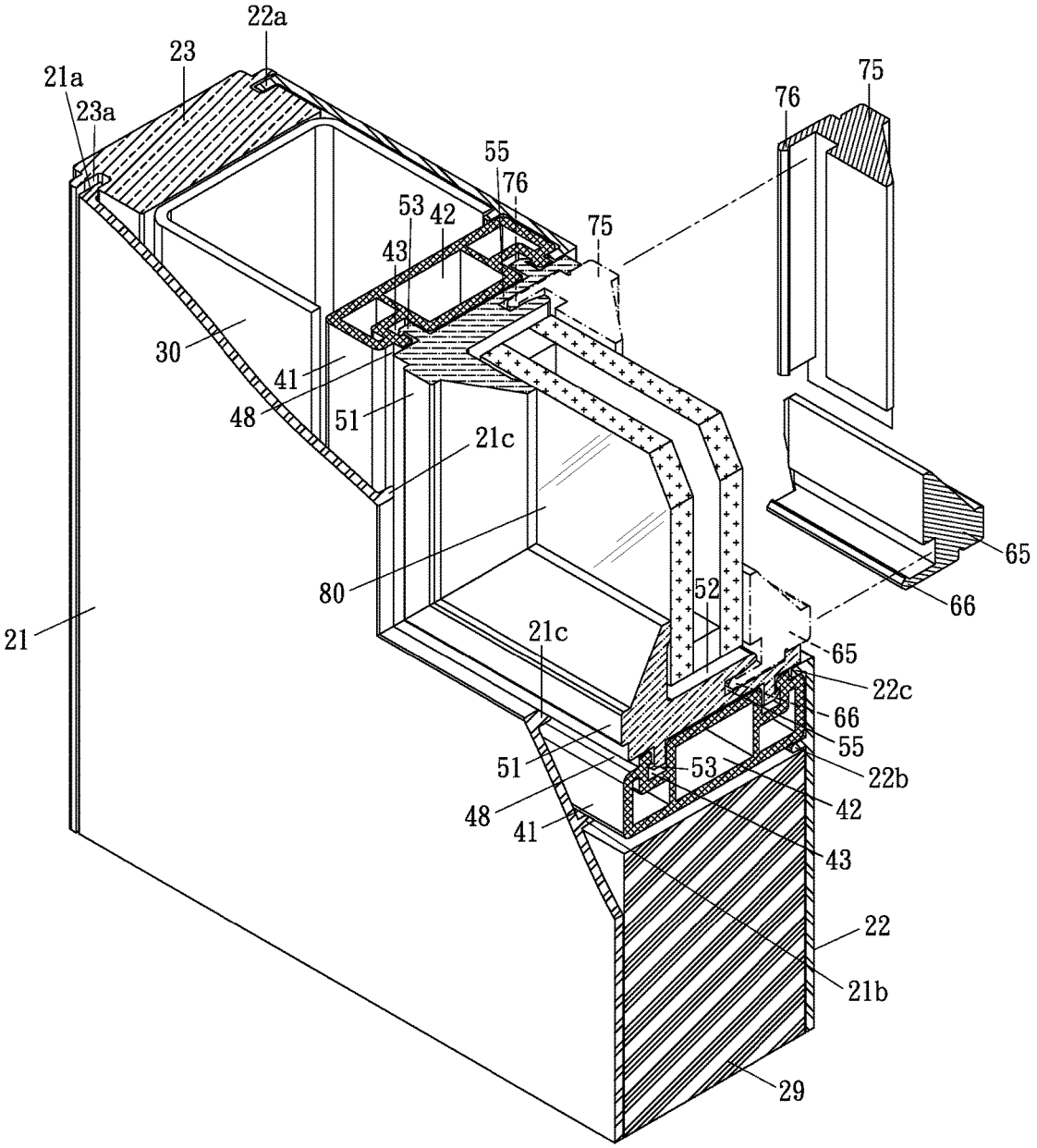
FIG. 4 is a detailed cross-sectional schematic of the door structure with glass along 4-4 in FIG. 2 and a demonstration of using horizontal glass stops or vertical glass stops.
Figure 8:
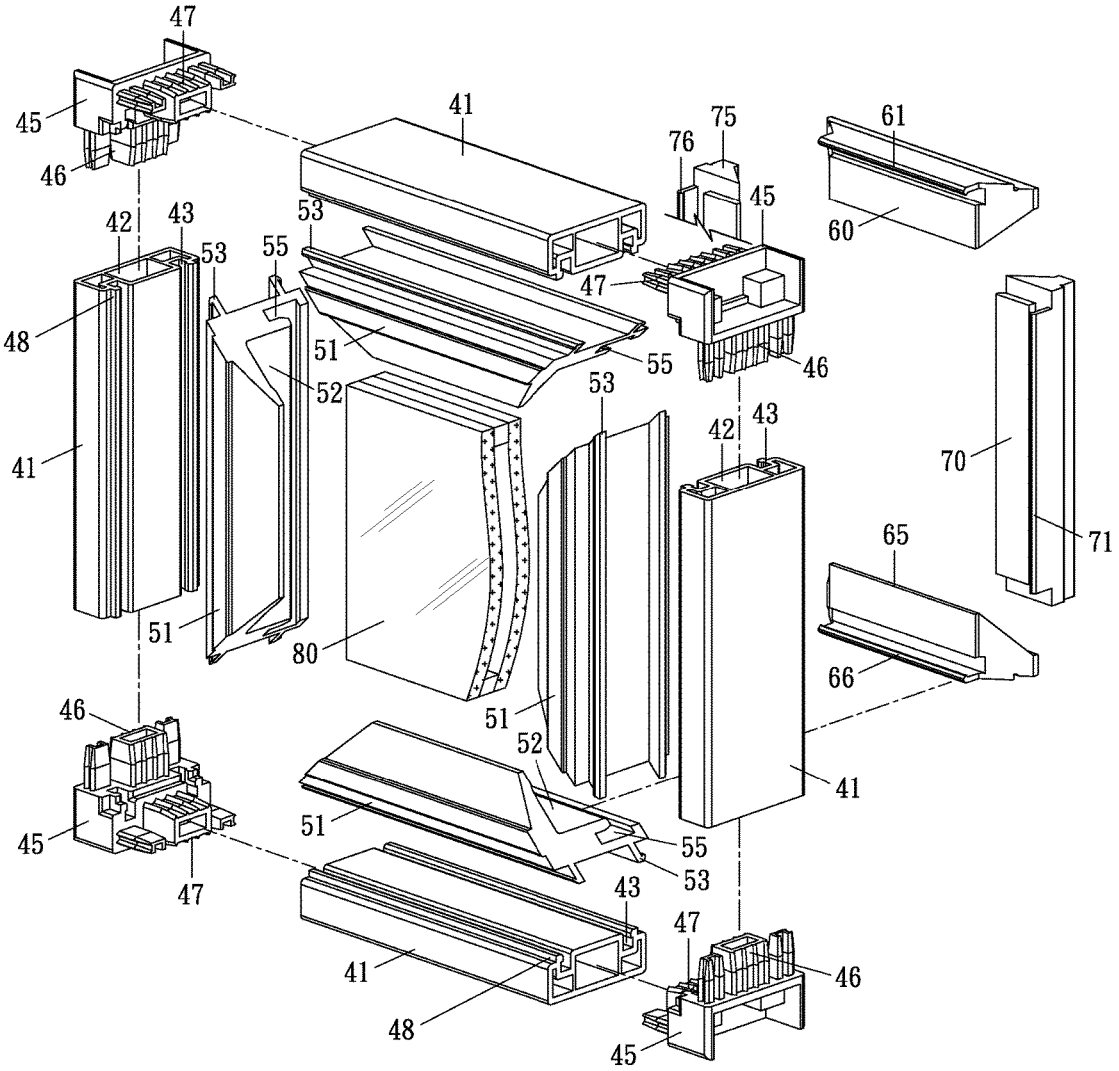
FIG. 8 is an exploded view of the inner hollowed-frame assembly and the glass mounted assembly of the door structure with glass in FIG. 3 and a demonstration of using horizontal glass stops and vertical glass stops with the glass mounted assembly.

As shown in FIG. 4, FIG. 5, and FIG. 8, the horizontal glass stops 60 and 65 are sealing stops of identical structure; the material of the horizontal glass stops 60 and 65 may be metal, wood or plastic. The horizontal glass stop 60 is configured with a tenon portion 61, and the horizontal glass stop 65 is also similarly configured with a tenon portion 66.

The vertical glass stops 70 and 75 are sealing stops of identical structure; the material of the vertical glass stops 70 and 75 may be metal, wood or plastic. The vertical glass stop 70 is configured with a tenon portion 71, and the vertical glass stop 75 is also similarly configured with a tenon portion 76.

More particularly, the vertical glass stops 70 and 75 may be made with a structure identical to or different from that of the horizontal glass stops 60 and 65. For example, when the contour of the inner hollowed-frame assembly 40 of the door structure with glass 20 is triangular, three horizontal glass stops 60 and 65 or vertical glass stops 70 and 75 of identical structure may be selected as the sealing stops. In another example, when the contour of the inner hollowed-frame assembly 40 of the door structure 20 is rectangular, four horizontal glass stops 60 and 65 and vertical glass stops 70 and 75 of identical structure may be selected as the sealing stops, or two horizontal glass stops 60 and 65 may be selected as the top and bottom sealing stops, respectively, and two vertical glass stops 70 and 75 with a structure different from that of the horizontal glass stops 60 and 65 may be selected as the right and left sealing stops, respectively.

Therefore, the basic structure of the door structure 20 of the present invention comprises two panels 21 and 22 of identical structure, two vertical stiles 23 and 25 of identical structure, two horizontal rails 27 and 29 of identical structure, two reinforcing materials 30 of identical structure, an inner hollowed-frame assembly 40, a glass mounted assembly 50, at least three glass stops, and at least one glass 80, and all components assembled together as the door structure 20 with glass 80 by mortise and tenon joints and do not require using screws to assemble.

As shown in FIG. 2 to FIG. 5 and FIG. 8, the glass mounted assembly 50 is assembled on an inner side of the hollow contour of the inner hollowed-frame assembly 40. The glass mounted assembly 50 comprises at least three edge-sealing frame modules 51; the material of the edge-sealing frame modules 51 may be metal, wood, or plastic.

The edge-sealing frame module 51 comprises a mounting portion 52, a hook rib portion 53, and a mortise portion 55, wherein a side of the glass 80 is located at the mounting portion 52, wherein the hook rib portion 5 is joined into a corresponding groove 43 of the inner frame module 41 by a mortise and tenon joint so that the edge-sealing frame module 51 is assembled with the corresponding inner frame module 41 without using screws to assemble, and wherein the mortise portion 55 is coupled with the tenon portion 61 and 66 of the horizontal glass stop 60 and 65 by a mortise and tenon joint or coupled with the tenon portion 71 and 76 of the vertical glass stop 70 and 75 by a mortise and tenon joint.

As shown in FIG. 3 to FIG. 7, the two panels 21 and 22 are door panels of identical structure, and each is configured with a hollow portion and further has a first protrusion 21*c* (or 22*c*) inwardly extended a protrusion from the perimeter of hollow portion for use in coupling with the locating wall 48 of the inner frame module 41 of the inner hollowed-frame assembly 40 when assembled; the two panels 21 and 22 constitute a front panel and a rear panel of the door structure 20, respectively, when assembled; the material of the panels 21 and 22 may be metal, wood or plastic.

Both sides of the panel 21 (or 22) are configured into L-shaped tenon plates 21*a* (or 22*a*), and the panel 21 (or 22) is further configured with a plurality of positioning protrusions 21*b* (or 22*b*) formed at the inner side around the hollow portion and spaced out a distance apart from the first protrusion 21*c* (or 22*c*).

When assembled, the L-shaped tenon plates 21*a* (or 22*a*) on both sides of the panel 21 (or 22) engage and lock with the vertical groove 23*a* of the vertical stile 23 and the vertical groove 25*a* of the vertical stile 25 respectively.

Figure 3:
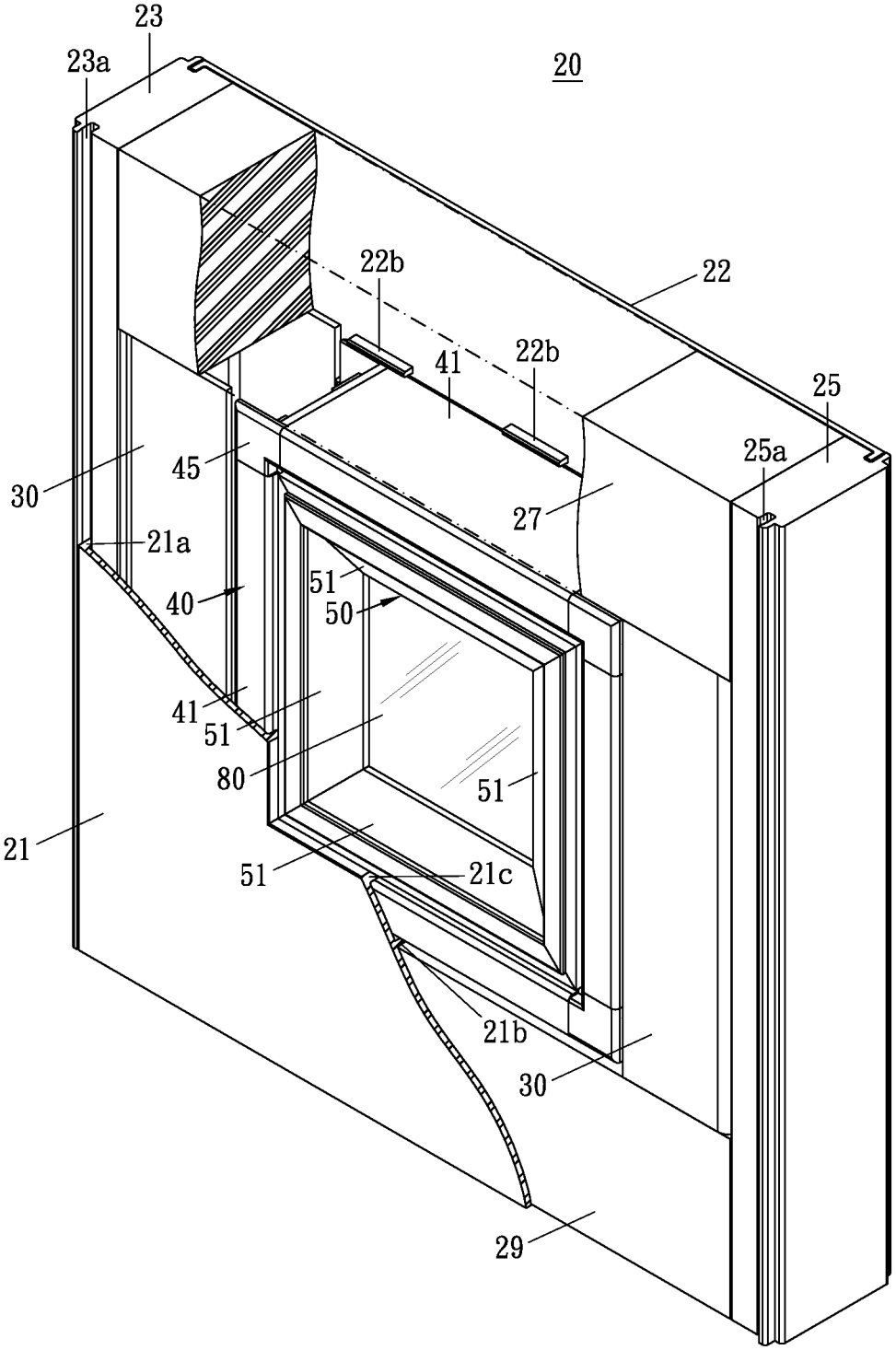
FIG. 3 is a schematic of the internal structure of the door structure with glass of FIG. 2.
Figure 6:
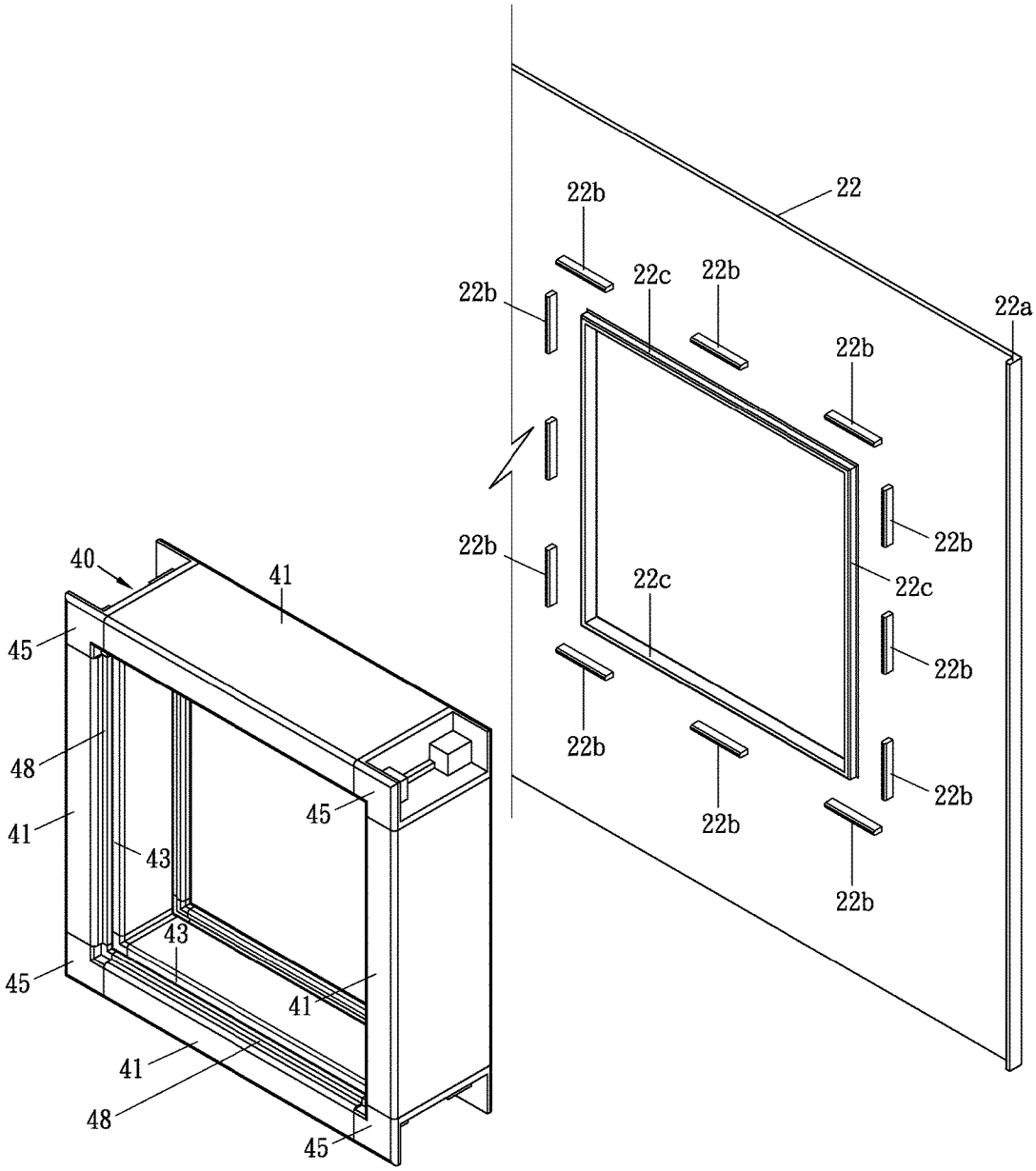
FIG. 6 is a demonstration of positioning protrusions of the door structure with glass in FIG. 2 used for fixing an inner hollowed-frame assembly.
Figure 7:
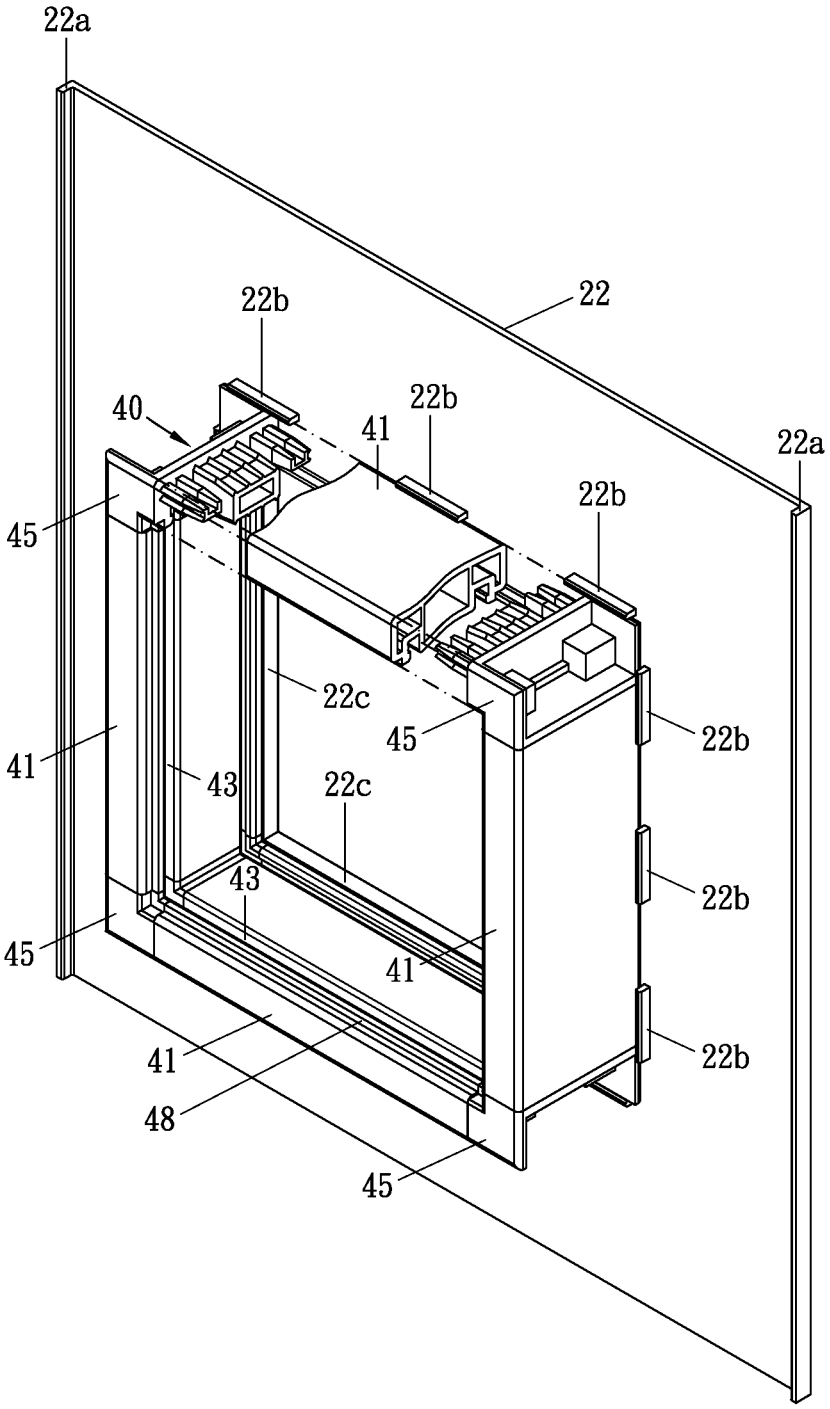
FIG. 7 is a schematic of the positioning protrusions of the door structure with glass in FIG. 2 fixing the inner hollowed-frame assembly.

As shown in FIG. 3, FIG. 6, and FIG. 7, in addition to the first protrusion 21*c* (or 22*c*) of the panel 21 (or 22) being designed for coupling with the locating wall 48 of the inner frame module 41 of the inner hollowed-frame assembly 40, those positioning protrusions 21*b* (or 22*b*) of the panel 21 (or 22) are configured according to the outer contour of the inner hollowed-frame assembly 40 to fix the inner hollowed-frame assembly 40 as well as the glass mounted assembly 50 in advance assembled to the inner hollowed-frame assembly 40, and firmly fix the outer contour of the inner hollowed-frame assembly 40 in between the plurality of positioning protrusions 21*b* and the plurality of positioning protrusions 22*b* without using screws to assemble; therefore, the purpose of assembling the inner hollowed-frame assembly 40 inside the door structure with glass 20 may be achieved, and the glass mounted assembly 50 may obtain rigid support from the inner hollowed-frame assembly 40 and the plurality of positioning protrusions 21*b* and 22*b* so that the sides of the glass 80 may be located within and the weight of the glass 80 may be supported.

As shown in FIG. 3 to FIG. 5, the reinforcing materials 30 may be made of metal, wood or plastic and are assembled inside the door structure 20, and specifically inside the space among the two vertical stiles 23 and 25, two horizontal rails 27 and 29, and the inner hollowed-frame assembly 40. In addition to reinforcing the overall structural strength of the door structure 20, polyurethane (PU) foamed plastic is optionally filled inside the door structure 20 of the invention.

Figure 2:
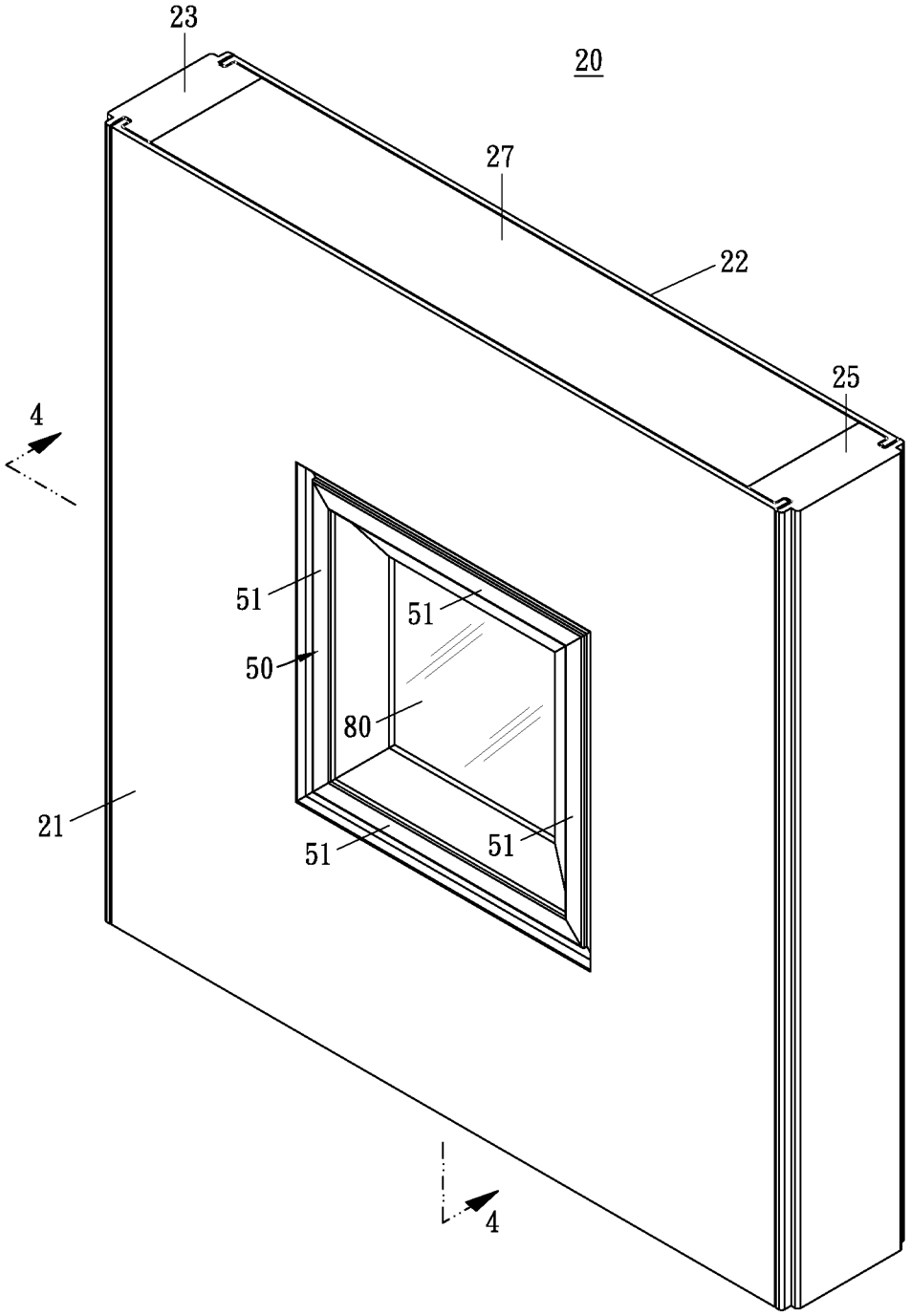
FIG. 2 is a three-dimensional schematic of a door structure with glass according to an embodiment of the invention.

As shown in FIG. 2 and FIG. 4, after completely assembling the panels 21 and 22, the vertical stiles 23 and 25, the horizontal rails 27 and 29, the reinforcing materials 30, the inner hollowed-frame assembly 40 and the glass mounted assembly 50, the sides of the glass 80 are located at the mounting portions 52 of the edge-sealing frame modules 51 of the glass mounted assembly 50, and the tenon portions 61 and 66 of the horizontal glass stops 60 and 65 and the tenon portions 71 and 76 of the vertical glass stops 70 and 75 are combined with the mortise portions 55 of the edge-sealing frame modules 51 of the glass mounted assembly 50 by mortise and tenon joints, and thereby installing the glass 80 and assembling the door structure 20 with glass 80 of the invention without using screws.

The door structure 20 with glass 80 of the invention may be used for applications including hinged doors or sliding doors with glass. The glass 80 of the door structure 20 of the invention may be substituted with a metal, wooden or plastic ornamental panel.

What is claimed is:

1. A door structure, comprising:

two identical panels, constituting a front panel and a rear panel of a door respectively, and each panel configured with a hollow portion, a first protrusion inwardly extended from a perimeter of the hollow portion, and a plurality of positioning protrusions formed around the hollow portion and spaced out a distance apart from the first protrusion;

two identical vertical stiles, constituting a left stile and a right stile—of the door respectively;

two identical horizontal rails, constituting a top rail and a bottom rail of the door respectively, an inner hollowed-frame assembly, comprising at least three inner frame modules and at least three connector pieces, wherein each inner frame module is an elongated body having an elongated locating wall coupled with the first protrusion of the front panel or the rear panel and each inner frame module further has an outer contour fixed in between the positioning protrusions of the front panel and the rear panel;

two reinforcing materials, assembled among the vertical stiles, horizontal rails and the inner hollowed-frame assembly respectively;

a glass mounted assembly, assembled to the inner hollowed-frame assembly;

at least one piece of glass, mounted to the glass mounted assembly; and at least three glass stops, each coupled with the glass mounted assembly to seal and fix the glass having been mounted at the glass mounted assembly.

2. The door structure as claimed in claim 1, wherein the material of the front panel, the rear panel, the vertical stiles, the horizontal rails, the inner hollowed-frame assembly, the reinforcing materials, the glass mounted assembly or the glass stops is metal, wood, or plastic.

3. The door structure as claimed in claim 1, wherein both sides of the front panel and the rear panel are configured into L-shaped tenon plates, and wherein sides of the vertical stiles that contact with the front panel and the rear panel are configured with vertical grooves, respectively, for the L-shaped tenon plate of the front panel and the L-shaped tenon plate of the rear panel to engage and lock, respectively.

4. The door structure as claimed in claim 1, wherein each inner frame module has a mortise configured at each end thereof, and each connector piece is configured with a first tenon connected with the mortise of one of the inner frame modules and a second tenon connected with the mortise of another neighboring inner frame module by a mortise and tenon joint.

5. The door structure as claimed in claim 4, wherein the angle between the first tenon and the second tenon of the connector piece is of 60 degrees, 90 degrees, 120 degrees or 150 degrees.

6. The door structure as claimed in claim 5, wherein each inner frame module further has a groove formed along the elongated body of the inner frame module, the glass mounted assembly comprises at least three edge-sealing frame modules each has a mounting portion for the glass mounted therein and a hook rib portion joined into a corresponding groove of the inner frame module.

7. The door structure as claimed in claim 6, wherein the edge-sealing frame module further comprises a mortise portion, and each glass stop is configured with a tenon portion coupled with the mortise portion of the edge-sealing frame module.

8. The door structure as claimed in claim 4, wherein each inner frame module further has a groove formed along the elongated body of the inner frame module, the glass mounted assembly comprises at least three edge-sealing frame modules each has a mounting portion for the glass mounted therein and a hook rib portion joined into a corresponding groove of the inner frame module.

9. The door structure as claimed in claim 8, wherein the edge-sealing frame module further comprises a mortise portion, and each glass stop is configured with a tenon portion coupled with the mortise portion of the edge-sealing frame module.

* * * * *